US012420375B2

(12) United States Patent
Pai et al.

(10) Patent No.: US 12,420,375 B2
(45) Date of Patent: Sep. 23, 2025

(54) POLISHING PAD AND POLISHING METHOD

(71) Applicant: IV Technologies CO., Ltd., Taichung (TW)

(72) Inventors: Kun-Che Pai, Taichung (TW); Wei Chen Liu, Taichung (TW); Chung-Ru Wu, Kaohsiung (TW)

(73) Assignee: IV TECHNOLOGIES CO., LTD, Taichung (TW)

( * ) Notice: Subject to any disclaimer, the term of this patent is extended or adjusted under 35 U.S.C. 154(b) by 380 days.

(21) Appl. No.: 17/696,906

(22) Filed: Mar. 17, 2022

(65) Prior Publication Data

US 2022/0314391 A1 Oct. 6, 2022

(30) Foreign Application Priority Data

Apr. 1, 2021 (TW) ..... 110112222

(51) Int. Cl.
*B24B 37/22* (2012.01)
*B24B 37/04* (2012.01)

(52) U.S. Cl.
CPC ..... *B24B 37/22* (2013.01); *B24B 37/042* (2013.01)

(58) Field of Classification Search
CPC ..... B24B 37/22; B24B 37/26; B24B 37/24; B24B 37/245; B24B 37/16; B24B 37/04; B24B 37/20
USPC ..... 451/317, 59, 283, 550, 530
See application file for complete search history.

(56) References Cited

U.S. PATENT DOCUMENTS

| | | | | |
|---|---|---|---|---|
| 5,913,713 | A * | 6/1999 | Cheek | B24B 37/26 451/6 |
| 6,217,426 | B1 * | 4/2001 | Tolles | B24B 37/26 451/526 |
| 7,059,950 | B1 * | 6/2006 | Muldowney | B24B 37/26 451/527 |
| 7,807,252 | B2 * | 10/2010 | Hendron | B24B 37/26 438/692 |
| 9,308,620 | B2 * | 4/2016 | Schutte | B24B 37/26 |
| 10,195,713 | B2 * | 2/2019 | Norimoto | B24B 37/24 |
| 2006/0128291 | A1 * | 6/2006 | Muldowney | B24B 37/26 451/527 |
| 2007/0072526 | A1 | 3/2007 | Ladjias | |

(Continued)

FOREIGN PATENT DOCUMENTS

| | | |
|---|---|---|
| CN | 110385640 | 10/2019 |
| JP | 2007035917 | 2/2007 |

(Continued)

OTHER PUBLICATIONS

Machine translation of WO-03103959-A1 (Year: 2003).*
"Office Action of China Counterpart Application", issued on Jan. 22, 2024, p. 1-p. 16.

*Primary Examiner* — Robert F Neibaur
(74) *Attorney, Agent, or Firm* — Birch, Stewart, Kolasch & Birch, LLP

(57) ABSTRACT

A polishing pad adapted for polishing an object and having a polishing track region is provided. The polishing pad includes a polishing layer and an adhesive layer. The polishing layer has a polishing surface and a rough bottom surface opposite to each other, and the rough bottom surface includes a plurality of discontinuous dents. The adhesive layer is adhered to the rough bottom surface.

25 Claims, 7 Drawing Sheets

(56) References Cited

U.S. PATENT DOCUMENTS

| | | | | |
|---|---|---|---|---|
| 2011/0269380 | A1* | 11/2011 | Wang | B24B 37/22 451/41 |
| 2017/0151648 | A1* | 6/2017 | Huang | B24D 18/0045 |
| 2019/0321936 | A1* | 10/2019 | Wang | B24D 18/00 |
| 2020/0238472 | A1* | 7/2020 | Ahn | B24B 37/26 |
| 2021/0388234 | A1* | 12/2021 | Kato | B32B 25/12 |

FOREIGN PATENT DOCUMENTS

| | | | | |
|---|---|---|---|---|
| JP | 2010056184 | | 3/2010 | |
| JP | 2016074052 | | 5/2016 | |
| TW | 1288048 | | 10/2007 | |
| TW | 200823014 | | 6/2008 | |
| TW | 201943495 | | 11/2019 | |
| TW | 202045304 | | 12/2020 | |
| WO | 03105191 | | 12/2003 | |
| WO | WO-03103959 | A1 * | 12/2003 | B24B 37/22 |

* cited by examiner

POLISHING PAD AND POLISHING METHOD

CROSS-REFERENCE TO RELATED APPLICATION

This application claims the priority benefit of Taiwan application serial no. 110112222, filed on Apr. 1, 2021. The entirety of the above-mentioned patent application is hereby incorporated by reference herein and made a part of this specification.

BACKGROUND

Technical Field

The present invention relates to a polishing pad and a polishing method, and more particularly to a polishing pad with improved adhesion to an adhesive layer and a polishing method using the polishing pad.

Description of Related Art

In the manufacturing processes of industrial devices, the polishing process is currently the more commonly used technique to planarize the surface of an object to be polished. During the polishing process, a slurry may be supplied between the surface of an object and a polishing pad, with a relative movement between the object and the polishing pad generating mechanical friction for planarization. Interfaces between layers of the polishing pad are usually adhered firmly with adhesive layers, but the slurry, byproduct (such as debris generated by the polishing or product resulting from the reaction between the slurry and the object surface), or heat generated by friction during the polishing process may cause the adhesive layers to deteriorate, deform, or decrease in adhesion, resulting in potential delamination between the layers of the polishing pad that affects the stability of the polishing pad.

Therefore, a means for improving the stability of the polishing pad is still required for the industry to choose from.

SUMMARY

The present invention provides a polishing pad and a polishing method, such that the polishing pad may have improved stability.

The polishing pad of the present invention is adapted for polishing an object, has a polishing track region, and includes a polishing layer and an adhesive layer. The polishing layer has a polishing surface and a rough bottom surface opposite to each other, and the rough bottom surface includes a plurality of discontinuous dents. The adhesive layer is adhered to the rough bottom surface.

The polishing pad of the present invention is adapted for polishing an object, has a polishing track region, and includes a polishing layer, a base layer, and an adhesive layer. The base layer is disposed below the polishing layer. The base layer has a rough surface, and the rough surface includes a plurality of discontinuous dents. The adhesive layer is adhered to the rough surface.

The polishing method of the present invention includes the following steps: the polishing pad described above is provided, an object is placed on the polishing surface of the polishing pad by applying a pressure to the object, and relative movement between the object and the polishing pad is performed for a polishing process.

Based on the above, the polishing pad of the present invention includes a polishing layer with a plurality of discontinuous dents on its bottom surface and an adhesive layer that adheres to the bottom surface and is filled into the discontinuous dents; alternatively, the polishing pad of the present invention includes a base layer with a plurality of discontinuous dents on its surface and an adhesive layer filled into the discontinuous dents. Therefore, the adhesive force and the adhesive holding force between the adhesive layer and the polishing layer are enhanced, or the adhesive force and the adhesive holding force between the adhesive layer and the base layer are enhanced. In this way, the polishing pad of the present invention may have improved stability.

DESCRIPTION OF THE EMBODIMENTS

The usages of "approximately" indicated throughout the specification include the indicated value and an average value having an acceptable deviation range, which is a certain value confirmed by people skilled in the art, and is a certain amount considered the discussed measurement and measurement-related deviation (that is, the limitation of measurement system). For example, "approximately" may indicate to be within one or more standard deviations of the indicated value, such as being within ±30%, ±20%, ±15%, ±10%, or ±5%. Furthermore, the usages of "approximately" indicated throughout the specification may refer to a more acceptable deviation scope or standard deviation depending on measurement properties, cutting properties, or other properties, and all properties may not be applied with one standard deviation.

Figure 1:
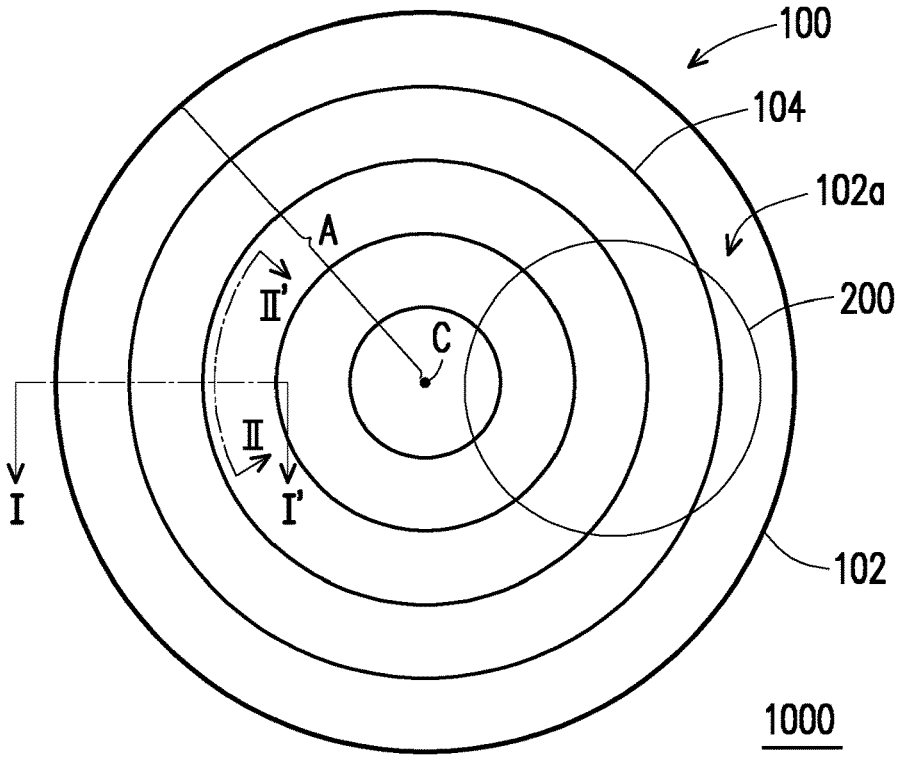
FIG. 1 is a schematic top view of a polishing pad and a polishing system according to an embodiment of the present invention.
Figure 2:
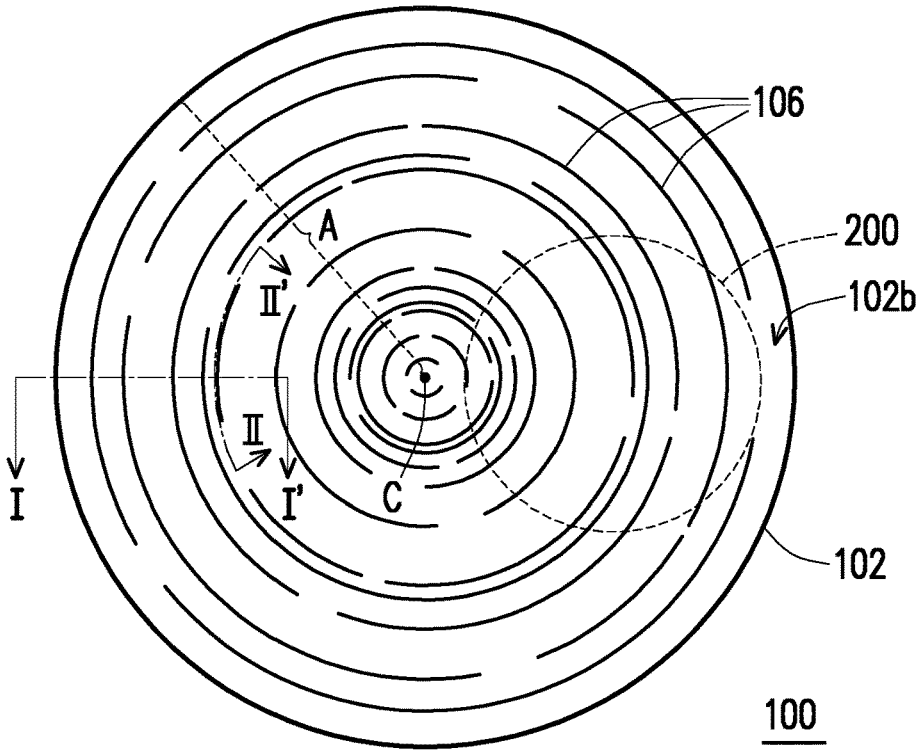
FIG. 2 is a schematic back view of a polishing pad according to an embodiment of the present invention.
Figure 3:
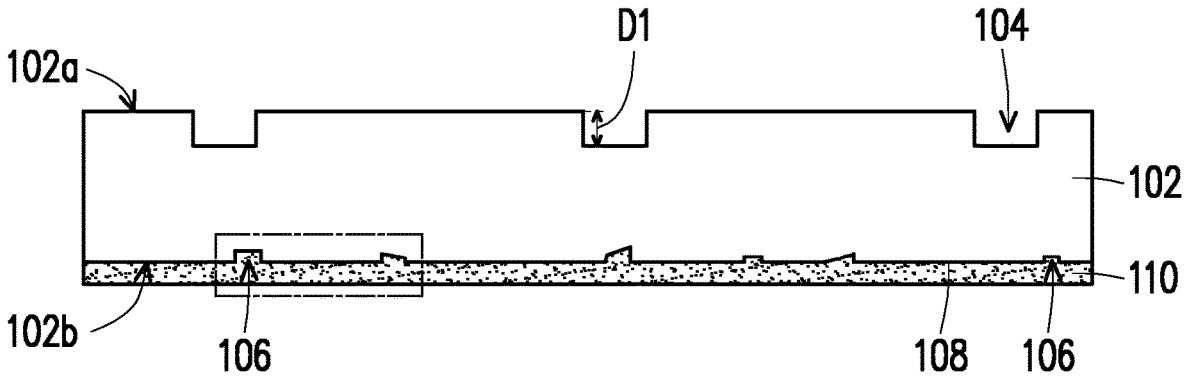
FIG. 3 is a schematic cross-sectional view taken along a section line I-I' in FIG. 1 and FIG. 2.
Figure 4:
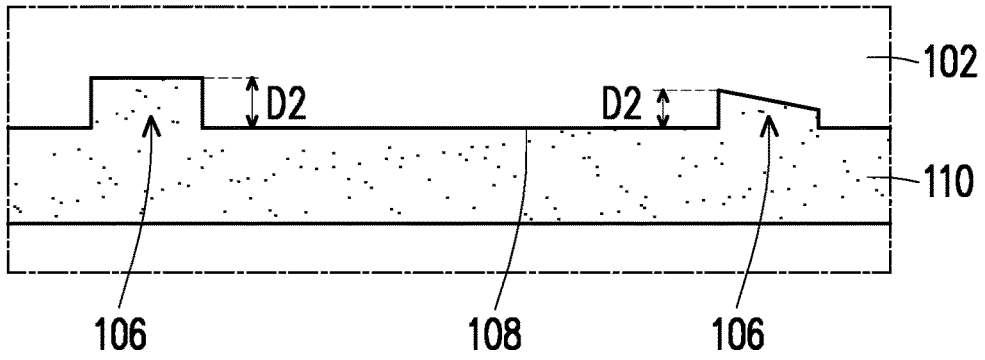
FIG. 4 is a partially enlarged schematic view of the polishing pad in FIG. 3.
Figure 5:
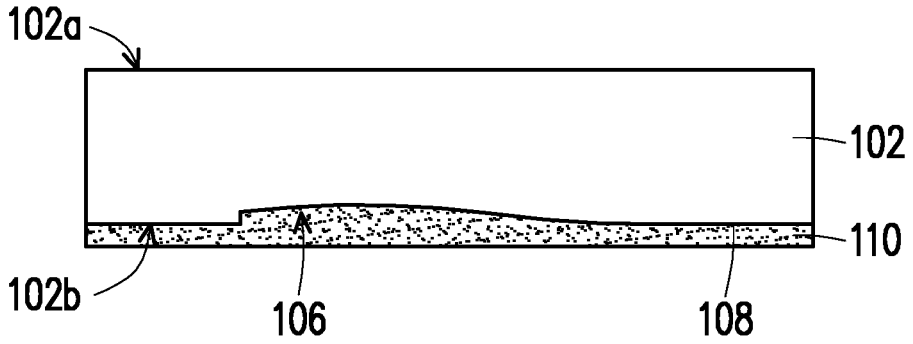
FIG. 5 is a schematic cross-sectional view taken along a section line II-II' in FIG. 1 and FIG. 2.

FIG. 1 is a schematic top view of a polishing pad and a polishing system according to an embodiment of the present invention. FIG. 2 is a schematic back view of a polishing pad according to an embodiment of the present invention. FIG. 3 is a schematic cross-sectional view taken along a section line I-I' in FIG. 1 and FIG. 2. FIG. 4 is a partially enlarged schematic view of the polishing pad in FIG. 3. FIG. 5 is a schematic cross-sectional view taken along a section line II-II' in FIG. 1 and FIG. 2.

With reference to FIG. 1, a polishing system 1000 includes a polishing pad 100 and an object 200. With reference to FIG. 1 and FIG. 3, the polishing pad 100 includes a polishing layer 102 and an adhesive layer 110. The adhesive layer 110 is disposed below the polishing layer 102. In this embodiment, the polishing layer 102 is formed by, for example, a polymer matrix, which may be polyester, polyether, polyurethane, polycarbonate, polyacrylate, polybutadiene, or be formed by other suitable thermosetting resins or thermoplastic resins, but the present invention is not limited thereto. In addition to the polymer matrix, the polishing layer 102 may further include a conductive material, a polishing particle, a micro-sphere, or a soluble additive in the polymer matrix.

In this embodiment, the polishing layer 102 has a polishing surface 102*a*. When a polishing process is performed on the object 200 with the polishing pad 100, the object 200 contacts the polishing surface 102*a* of the polishing layer 102 and forms a polishing track on the polishing layer 102. In detail, as shown in FIG. 1, when the polishing process is performed on the object 200 with the polishing pad 100, the polishing track of the object 200 on the polishing surface 102*a* is located in a polishing track region A. In the shown embodiment, the polishing track region A is distributed throughout the polishing layer 102, but the present invention is not limited thereto. The polishing pad 100 may be adapted to any type of polishing system to polish the object 200, and the position of the object 200 relative to the polishing pad 100 may depend on the actual polishing process. In one embodiment, the polishing track region A may be disposed in the polishing layer 102 and not in contact with a rotation center C and an edge of the polishing pad 100. In another embodiment, the polishing track region A may be disposed in the polishing layer 102 and in contact with only the rotation center C or the edge of the polishing pad 100. In addition, during the polishing process, the polishing pad 100 rotates counterclockwise or clockwise around the rotation center C. The rotation center C is, for example, the center point of the polishing pad 100. Moreover, during the polishing process, the object 200 is driven by an object carrier (not shown) to move on the polishing surface 102*a* of the polishing layer 102. In other words, during the polishing process, a relative movement occurs between the object 200 and the polishing surface 102*a* of the polishing layer 102. In some embodiments, the object carrier (not shown) drives the object 200 to rotate on the polishing surface 102*a* of the polishing layer 102. In other embodiments, the object carrier (not shown) not only drives the object 200 to rotate on the polishing surface 102*a* of the polishing layer 102 but also drives the object 200 to swing on the polishing surface 102*a* of the polishing layer 102. In these embodiments, the distance of the swinging movement by the object 200 depends on the actual polishing process. In the above embodiment, the relative movement between the object 200 and the polishing surface 102*a* of the polishing layer 102 generates a shear force on the polishing surface 102*a*. In some embodiments, the shear force generated through the object carrier (not shown) driving the object 200 to rotate and swing on the polishing surface 102*a* of the polishing layer 102 is an annular cyclic shear force according to the principles of mechanics.

In this embodiment, the polishing surface 102*a* of the polishing layer 102 may include a plurality of polishing grooves 104, but the present invention is not limited thereto. The number of the polishing grooves 104 may depend on the actual polishing process, and the polishing pad 100 falls within the scope of the present invention as long as it includes at least one polishing groove 104. On the other hand, as shown in FIG. 1, in the shown embodiment, the distribution pattern of the polishing grooves 104 is a concentric circle, but the present invention is not limited thereto. In other embodiments, the distribution pattern formed by the polishing grooves 104 may be, for example, a non-concentric circle, an ellipse, a polygonal ring, a spiral ring, an irregular ring, parallel lines, radial lines, radial arcs, a spiral, dots, and XY grids, crosses, polygonal grids, irregular shapes, or a combination thereof. In addition, as shown in FIG. 3, the polishing groove 104 has a maximum depth D1.

In this embodiment, the polishing layer 102 has a bottom surface 102*b* opposite to the polishing surface 102*a*, and the bottom surface 102*b* includes a plurality of discontinuous dents 106, which means the bottom surface 102*b* of the polishing layer 102 in this embodiment is a non-flat surface. In other words, in this embodiment, the bottom surface 102*b* of the polishing layer 102 may be regarded as a rough bottom surface. As shown in FIG. 1 and FIG. 2, the discontinuous dents 106 on the bottom surface 102*b* are disposed in the polishing track region A.

As mentioned above, in the shown embodiment, the polishing track region A is distributed throughout the polishing layer 102, and the discontinuous dents 106 are therefore distributed throughout the bottom surface 102*b*, but the present invention is not limited thereto. As mentioned above, in other embodiments, depending on the selected polishing system, the discontinuous dents 106 may be distributed only in a part or in a specific region of the bottom surface 102*b*.

In this embodiment, the discontinuous dents 106 are spaced apart from each other. As shown in FIG. 2, the discontinuous dents 106 have non-fixed spacing in the radial direction. On the other hand, as shown in FIG. 2, the discontinuous dents 106 have non-fixed spacing in the circumferential direction. In other words, in the shown embodiment, the discontinuous dents 106 are irregularly distributed on the bottom surface 102*b*, but the present invention is not limited thereto. In other embodiments, the discontinuous dents 106 may have fixed spacing and be regularly distributed on the bottom surface 102*b*. For example, in one embodiment, the discontinuous dents 106 have fixed spacing both in the radial direction and the circumferential direction. From another point of view, as shown in FIG. 2 and FIG. 3, the bottom surface 102*b* further includes a continuous plane 108 connected to the discontinuous dents 106, which means the discontinuous dents 106 spaced apart from each other in this embodiment are connected to each other via the continuous plane 108. In other words, the region other than the discontinuous dents 106 on the bottom surface 102*b* is the continuous plane 108.

As shown in FIG. 3 to FIG. 5, the discontinuous dent 106 has a maximum depth D2 from the continuous plane 108. In some embodiments, the maximum depth D2 of the discontinuous dent 106 is between approximately 0.1 mm and approximately 0.2 mm. In addition, as shown in FIG. 3 and FIG. 4, the discontinuous dents 106 have the non-fixed maximum depth D2. In other words, as shown in FIG. 3 and FIG. 4, the bottoms of at least two of the discontinuous dents 106 on the bottom surface 102*b* are not on the same plane, but the present invention is not limited thereto. In other embodiments, the discontinuous dents 106 may have the fixed maximum depth D2. In other words, the discontinuous dents 106 on the bottom surface 102*b* have the bottoms on the same plane. Moreover, in this embodiment, the maximum depth D2 of the discontinuous dent 106 is less than the maximum depth D1 of the polishing grooves 104.

In this embodiment, the discontinuous dents 106 on the bottom surface 102*b* may be wear marks, knife marks, imprint marks, impact marks, or a combination thereof caused by applied force or energy. In one embodiment, when the discontinuous dents 106 are wear marks, the method of forming the bottom surface 102*b* having a plurality of discontinuous dents 106 includes a polishing process. The polishing process may be performed by using a polishing tape with polishing particles fixed on the surface thereof. In detail, the polishing process, for example, performs mechanical polishing between the polishing tape and the polishing layer 102 by the friction between the polishing tape and the bottom surface of the polishing layer 102 opposite to the polishing surface 102*a*, thereby forming the bottom surface 102*b* having the discontinuous dents 106. In another embodiment, when the discontinuous dents 106 are knife marks, the method of forming the bottom surface 102*b* having a plurality of discontinuous dents 106 includes a mechanical cutting process. The mechanical cutting process may be performed by using a cutting tool. In detail, cutting knife marks (i.e., the discontinuous dents 106) of different aspects may be generated by adjusting processing parameters such as rotation speed of a cutting platen, feed speed, cutting depth, cutting tools, materials and deformation characteristics of the polishing layer 102, and the like. In yet another embodiment, when the discontinuous dents 106 are imprint marks, the method of forming the bottom surface 102*b* having a plurality of discontinuous dents 106 includes an imprint process. The imprint process may be performed by using a printing plate with a pattern on the surface thereof. In detail, the imprint process, for example, heats and/or presses the printing plate and the bottom surface of the polishing layer 102 opposite to the polishing surface 102*a* after the printing plate contacts the bottom surface, thereby forming the bottom surface 102*b* having the discontinuous dents 106. In still another embodiment, when the discontinuous dents 106 are impact marks, the method of forming the bottom surface 102*b* having a plurality of discontinuous dents 106 includes an impact process. The impact process may be performed through the impact of small particles. In detail, the impact process is, for example, a shot peening process, where small metal particles (such as steel balls) hit the bottom surface of the polishing layer 102 opposite to the polishing surface 102*a* at a high speed to form the bottom surface 102*b* having the discontinuous dents 106.

In this embodiment, as shown in FIG. 2, the distribution pattern of the discontinuous dents 106 is a ring pattern. In other words, on the bottom surface 102*b*, the discontinuous dents 106 spaced apart from each other are disposed at the same radial position, but the present invention is not limited thereto. Various aspects are described in detail as follows with reference to FIG. 6A to FIG. 6D. FIG. 6A to FIG. 6D are schematic back views of polishing pads according to other embodiments of the present invention.

Figure 6A:
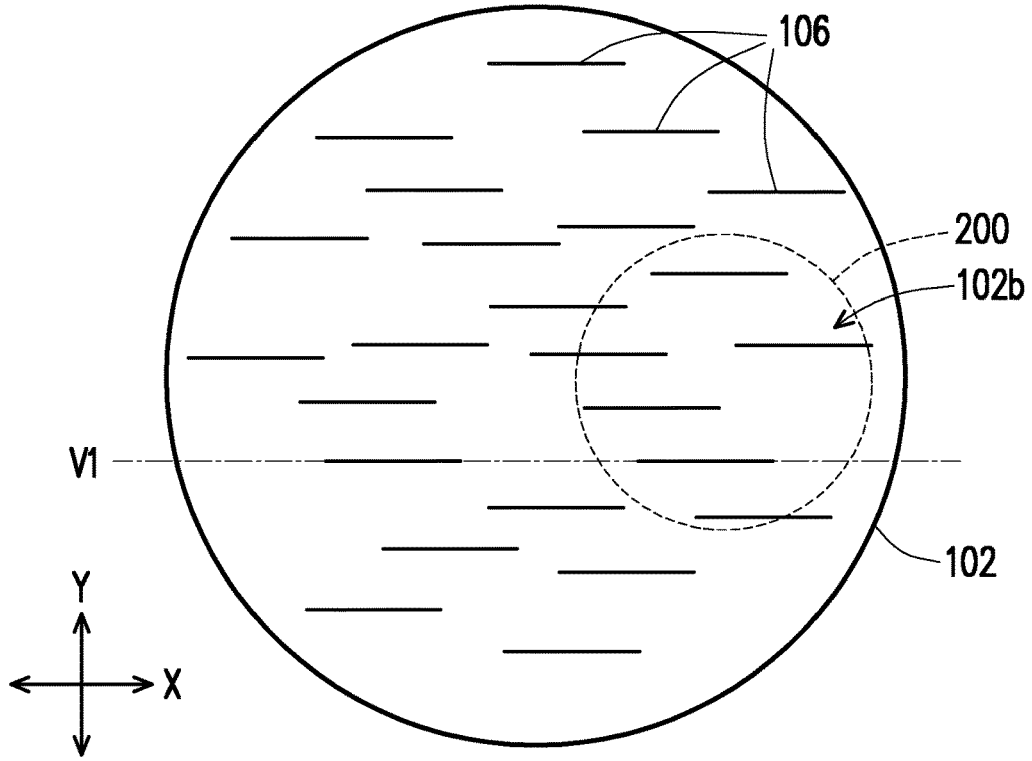
FIG. 6A to FIG. 6D are schematic back views of polishing pads according to other embodiments of the present invention.

In another embodiment, the distribution pattern of the discontinuous dents 106 may be a parallel pattern. As shown in FIG. 6A, the distribution pattern of the discontinuous dents 106 may be a parallel straight-line pattern, but the present invention is not limited thereto. In other embodiments, the distribution pattern of the discontinuous dents 106 may be a parallel curve pattern, a parallel dot pattern, a parallel arc pattern, or other parallel patterns. In addition, in the embodiment shown in FIG. 6A, at least two of the discontinuous dents 106 are located on a same virtual extension line V1. Moreover, in the embodiment shown in FIG. 6A, the discontinuous dents 106 are irregularly distributed on the bottom surface 102*b*. In detail, as shown in FIG. 6A, the discontinuous dents 106 have non-fixed spacing in a direction X parallel to the extension direction of the discontinuous dents 106 and a direction Y perpendicular to the direction X, but the present invention is not limited thereto. In other embodiments, in the direction X and the direction Y, the discontinuous dents 106 may have fixed spacing and be regularly distributed on the bottom surface 102*b*.

Figure 6B:
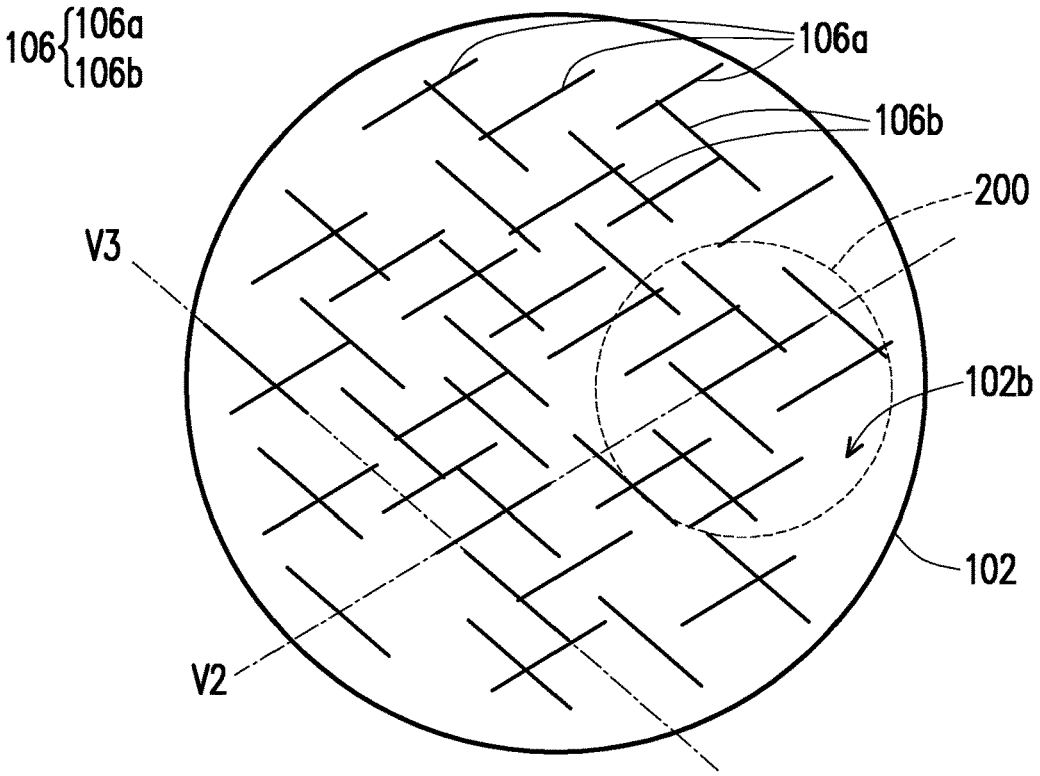

In another embodiment, the distribution pattern of the discontinuous dents 106 may be a non-parallel pattern. As shown in FIG. 6B, the non-parallel pattern presented by the discontinuous dents 106 as the distribution pattern may be implemented by a mesh pattern. In detail, in the embodiment shown in FIG. 6B, the discontinuous dents 106 include a plurality of discontinuous dents 106*a* and a plurality of discontinuous dents 106*b*, with the extension direction of the discontinuous dents 106*a* intersecting the extension direction of the discontinuous dents 106*b*. As shown in FIG. 6B, although the included angle between the extension direction of the discontinuous dents 106*a* and the extension direction of the discontinuous dents 106*b* is an acute angle, the present invention is not limited thereto. In other embodiments, the included angle between the extension direction of the discontinuous dents 106*a* and the extension direction of the discontinuous dents 106*b* may be a right angle or an obtuse angle. In addition, in the embodiment shown in FIG. 6B, at least two of the discontinuous dents 106*a* are located on a same virtual extension line V2, and at least two of the discontinuous dents 106*b* are located on a same virtual extension line V3. Moreover, in the embodiment shown in FIG. 6B, the discontinuous dents 106 are irregularly distributed on the bottom surface 102*b*. In detail, as shown in FIG. 6B, in the extension direction of the discontinuous dents 106*a* and the extension direction of the discontinuous dents 106*b*, the discontinuous dents 106 have non-fixed spacing, but the present invention is not limited thereto. In other embodiments, in the extension direction of the discontinuous dents 106*a* and the extension direction of the discontinuous dents 106*b*, the discontinuous dents 106 may have fixed spacing and be regularly distributed on the bottom surface 102*b*.

Figure 6C:
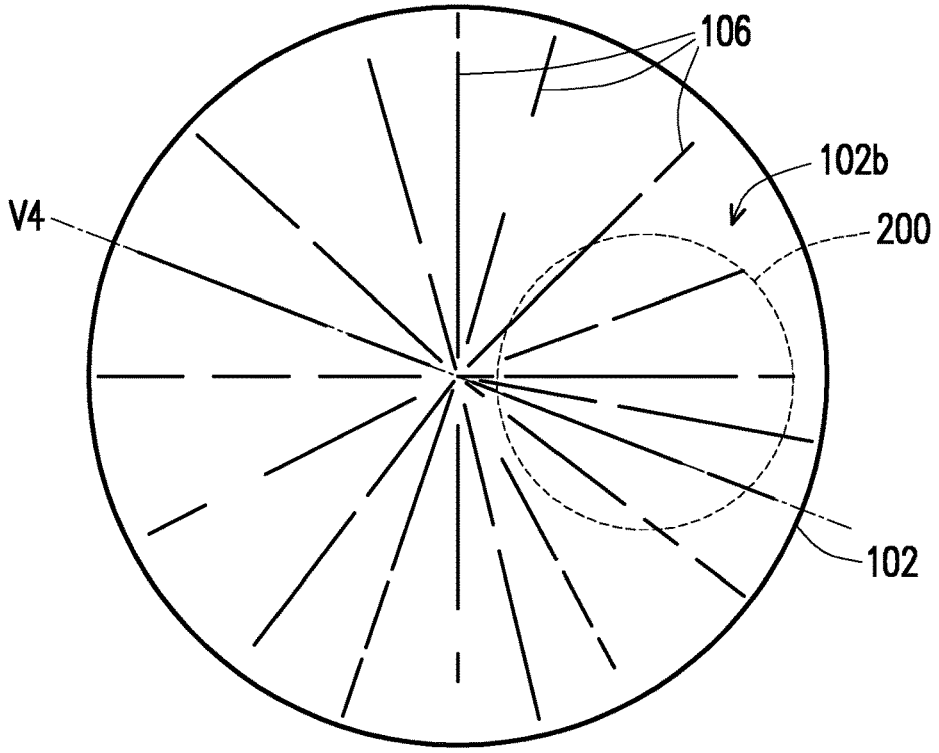
Figure 6D:
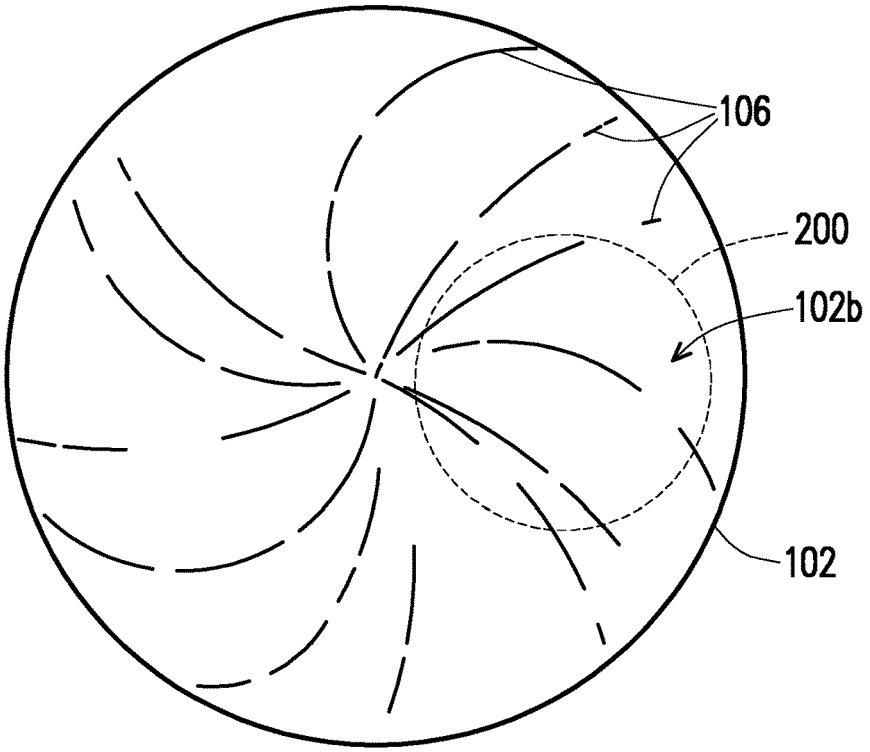

In addition, as shown in FIG. 6C, the non-parallel pattern presented by the discontinuous dents 106 as the distribution pattern may be implemented by a radial pattern. In the embodiment shown in FIG. 6C, at least two of the discontinuous dents 106 are located on a same virtual extension line V4. Moreover, in the embodiment shown in FIG. 6C, the discontinuous dents 106 are irregularly distributed on the bottom surface 102*b*. In detail, as shown in FIG. 6C, the discontinuous dents 106 have non-fixed spacing in the radial direction and the circumferential direction, but the present invention is not limited thereto. In other embodiments, in the radial direction and the circumferential direction, the discontinuous dents 106 may have fixed spacing and be regularly distributed on the bottom surface 102*b*. In addition, although the discontinuous dents 106 shown in FIG. 6C are straight lines, the present invention is not limited thereto. In other embodiments, the discontinuous dents 106 may be arcs as shown in FIG. 6D.

In this embodiment, the polishing layer 102 is a non-porous layer. Herein, a non-porous layer is defined as a layer with extremely few pores or even without any pore, but the present invention is not limited thereto. In other embodiments, the polishing layer 102 may be a porous layer. Herein, a porous layer is defined as a layer with a plurality of pores of different sizes, and the number of pores in the porous layer is greater than that of the non-porous layer. In still other embodiments, the polishing layer 102 may further include a porous layer and a non-porous layer. In some of these embodiments, the non-porous layer covers the porous layer, which means the bottom surface 102*b* is located on the surface of the bottom of the non-porous layer. In some of these embodiments, the non-porous layer is only located on the porous layer, which means the porous layer is closer to the adhesive layer 110 than the non-porous layer, and the bottom surface 102*b* is located on the surface of the bottom of the porous layer. In some of these embodiments, the non-porous layer is only located under the porous layer, which means the non-porous layer is closer to the adhesive layer 110 than the porous layer, and the bottom surface 102*b* is located on the surface of the bottom of the non-porous layer. In addition, the porous layer and the non-porous layer may be made of the same material (such as a polymer material). Moreover, the non-porous layer may be a skin layer, while the porous layers may be a body layer. The body layer and the skin layer are made of the same polymer material.

In this embodiment, as shown in FIG. 3, the adhesive layer 110 is adhered to the bottom surface 102*b* of the polishing layer 102. In one embodiment, the adhesive layer 110 may be used to make the bottom surface 102*b* of the polishing layer 102 adhere to a polishing platen (not shown). In other words, the polishing pad 100 may adhere to and be fixed on the polishing platen (not shown) through the adhesive layer 110 adhering to the bottom surface 102*b*. In this embodiment, the adhesive layer 110 is a continuous adhesive layer, and the adhesive layer includes (but is not limited to): a carrier-free adhesive layer or a double-sided adhesive layer. The material of the adhesive layer is, for example (but not limited to): an acrylic-based adhesive, a silicone-based adhesive, a rubber-based adhesive, an epoxy resin-based adhesive, or a polyurethane-based adhesive, but the present invention is not limited thereto.

As shown in FIG. 3 to FIG. 5, the adhesive layer 110 is filled into the discontinuous dents 106 of the bottom surface 102*b*. In this way, the contact area of the adhesive layer 110 and the polishing layer 102 may be increased, thereby increasing the adhesive holding force between the adhesive layer 110 and the polishing layer 102, such that the polishing pad 100 may stay adhered to the polishing machine in a favorable way during the polishing process and may have improved stability. In addition, as shown in FIG. 5, the depth of the discontinuous dent 106 may decrease gradually or increase gradually. In other words, along the direction in which the discontinuous dent 106 is formed, the discontinuous dent 106 has the non-fixed depth. Taking the discontinuous dent 106 with the depth decreasing gradually as an example, the discontinuous dent 106 forms a hook-like shape (as shown in FIG. 5), such that the adhesive layer 110 located in the discontinuous dent 106 also has a hook-like shape (as shown in FIG. 5) after the adhesive layer 110 is filled into the bottom surface 102*b*. In other words, in the polishing pad 100, a hook-like contact area exists between the adhesive layer 110 and the polishing layer 102. In this way, when an external force is applied to the polishing layer 102, the adhesive layer 110 and the polishing layer 102 may tightly adhere to each other with the hook-like contact area, such that the adhesive layer 110 and the polishing layer 102 are not detached due to the external force. Therefore, the adhesive holding force between the adhesive layer 110 and the polishing layer 102 may be effectively improved.

From another point of view, during the polishing process, by filling the adhesive layer 110 into the discontinuous dents 106 disposed in the polishing track region A on the bottom surface 102*b*, an anti-reverse force may be generated to resist against the shear force generated by the relative movement between the object 200 and the polishing surface 102*a* of the polishing layer 102 during the polishing process. In other words, the adhesive layer 110 and the polishing layer 102 have good anti-shear force characteristics. In this way, when the polishing pad 100 is used to perform the polishing process on the object 200, the discontinuous dents 106 located in the polishing track region A are disposed on the bottom surface 102*b* and may reduce the impact of the shear force on the adhesive layer 110, thereby reducing the occurrence of degumming of the adhesive layer 110 and improving the adhesive holding power thereof. In some embodiments, the shear force mentioned above belongs to an annular cyclic shear force based on the principles of mechanics, and is generated in the annular direction due to the rotating and swinging movement of the object 200 on the polishing pad during the polishing process.

In order to verify the effect of the polishing pad provided in the present invention on improving the adhesive holding force, an anti-shear force (adhesive holding force) experiment was actually done. In the experiment, the test method and sample settings used are as follows, with the test results listed in Table 1.

The anti-shear force (adhesive holding force) test method: adopting ASTM D3654 standard test method.

The material of the adhesive layer: acrylic adhesive.

Samples 1 to 10: Sample 1 is a test matrix without dents, and Samples 2 to 10 are test matrices with discontinuous dents at different angles. The depth of the foregoing discontinuous dents decreases gradually along the forming direction in this experiment, and the material of the foregoing test matrix is polyurethane polymer.

TABLE 1

| | Sample 1 | Sample 2 | Sample 3 | Sample 4 | Sample 5 |
|---|---|---|---|---|---|
| Angle (degree) | no dent | 0 | 30 | 45 | 60 |
| Anti-shear force maintenance time (hour) | 6.8 | 34.0 | 28.9 | 22.9 | 23.1 |

| | Sample 6 | Sample 7 | Sample 8 | Sample 9 | Sample 10 |
|---|---|---|---|---|---|
| Angle (degree) | 90 | 120 | 135 | 150 | 180 |
| Anti-shear force maintenance time (hour) | 22.2 | 27.8 | 30.5 | 30.0 | 36.0 |

Note:
The angle is an included angle between the forming direction of dents and the direction of the shear force (i.e., the direction of gravity).

According to Table 1, compared to Sample 1 without dents, Samples 2 to 10 with discontinuous wear marks have better anti-shear force maintenance time. During the polishing process, due to the relative movement between a polished object and a polishing pad that requires the polishing pad to be able to bear the shear force and remain still for a long time, the anti-shear force maintenance time is an exceptionally important indicator for testing the performance of a polishing pad. Accordingly, according to the above experimental results, compared with the polishing pad without discontinuous dents, the polishing pad with discontinuous dents formed on the polishing layer in the present invention has better adhesive holding performance and stability.

In addition, according to Table 1, relative to the direction of the shear force, different forming directions of the dents affect the anti-shear force characteristics between the adhesive layer and the samples. With Sample 2 and Sample 10 as examples, as mentioned above, the angle of 0 degrees of Sample 2 means the dent direction of Sample 2 is the same as the direction of the shear force, while the angle of 180 degrees of Sample 10 means the dent direction of Sample 10 is opposite to the direction of the shear force. According to the results shown in Table 1, Sample 2 and Sample 10 respectively have the anti-shear force maintenance time of 34 hours and 36 hours, which are about five times longer than the anti-shear force maintenance time of 6.8 hours of Sample 1 without dents. In addition, as mentioned above, the discontinuous dents formed in this test create a shape with the depth decreasing gradually, such that the adhesive layer of Sample 2 and Sample 10 is filled into the dents according to the shape of the dents and has the same shape. Since Sample 2 has the same dent forming direction as the shear force direction, forming a hook-like effect slightly less stronger than that formed by Sample 10 whose dent forming direction is opposite to the shear force direction, the anti-shear force maintenance time of Sample 10 is longer than that of Sample 2. In summary, in the polishing pad of the present invention, the distribution pattern of the discontinuous dents 106 in the polishing track region A may be adjusted according to the actual polishing process (such as the aspect where the relative movement is performed between the object 200 and the polishing surface 102*a*), in order to improve the anti-shear force characteristics (adhesive holding force) between the adhesive layer 110 and the polishing layer 102.

As described above, in the embodiment shown in FIG. 1 to FIG. 5, the polishing pad 100 includes the polishing layer 102 and the adhesive layer 110 disposed below the polishing layer 102, and the polishing pad 100 is adhered to and is fixed on the polishing platen through the adhesive layer 110, but the present invention is not limited thereto. In other embodiments, the polishing pad 100 may further include a base layer, a waterproof layer, other adhesive layers disposed under the adhesive layer 110, or a combination thereof. Various aspects are described in detail as follows with reference to FIG. 7 and FIG. 8.

Figure 7:
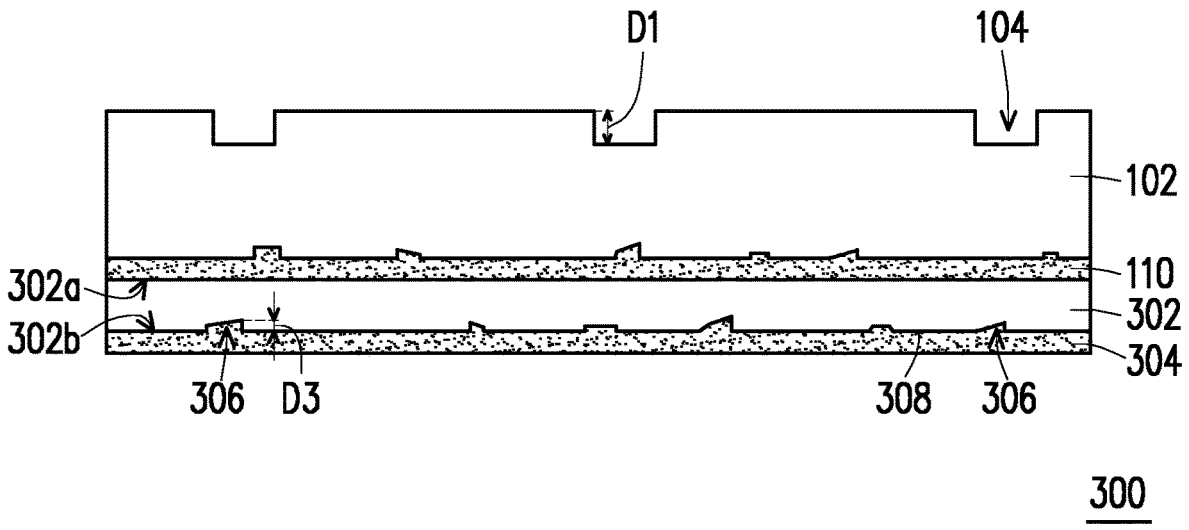
FIG. 7 is a schematic cross-sectional view of a polishing pad according to another embodiment of the present invention.

FIG. 7 is a schematic cross-sectional view of a polishing pad according to another embodiment of the present invention. With reference to FIG. 7 and FIG. 3 together, a polishing pad 300 of FIG. 7 is similar to the polishing pad 100 of FIG. 3. The same or similar elements are denoted by the same or similar reference numerals, and the related description is not repeated herein. The differences between the two are explained as follows.

With reference to FIG. 7, the polishing pad 300 includes a base layer 302 and an adhesive layer 304 disposed below the adhesive layer 110. In detail, the main function of the base layer 302 is to support the polishing layer 102, such that the polishing layer 102 and the base layer 302 may be adhered together with the adhesive layer 110. As shown in FIG. 7, in this embodiment, the adhesive layer 110 is adhered to a surface 302*a* of the base layer 302. The material of the base layer 302 used in this embodiment may be, for example, polyurethane, polybutadiene, polyethylene, polypropylene, a copolymer of polyethylene and ethylene vinyl acetate, or a copolymer of polypropylene and ethylene vinyl acetate, but the present invention is not limited thereto. In this embodiment, the adhesive layer 110 is a continuous adhesive layer, and the adhesive layer includes (but is not limited to): a carrier-free adhesive, a double-sided adhesive, a hot melt adhesive, or a moisture curing adhesive. The material of the adhesive layer may be, for example (but not limited to): an acrylic-based adhesive, a silicone-based adhesive, a rubber-based adhesive, an epoxy resin-based adhesive, or a polyurethane-based adhesive, but the present invention is not limited thereto.

As shown in FIG. 7, in this embodiment, a surface 302*b* of the base layer 302 opposite to the surface 302*a* includes a plurality of discontinuous dents 306, which means the surface 302*b* of the base layer 302 in this embodiment is a non-flat surface. In other words, in this embodiment, the surface 302*b* of the base layer 302 may be regarded as a rough surface. The discontinuous dent 306 in the embodiment shown in FIG. 7 is the same as or similar to the counterpart (i.e., the discontinuous dent 106) in the embodiment shown in FIG. 1. As some of the details related to the discontinuous dent 106 have been described in the previous embodiments and are not repeated herein, reference may be made to the previous embodiments shown in FIG. 1 to FIG. 6D for the description of the omitted part. In addition, as shown in FIG. 7, since the surface 302*a* is closer to the polishing layer 102 than the surface 302*b*, the surface 302*a* may be referred to as the upper surface of the base layer 302, while the surface 302*b* may be referred to as the lower surface of the base layer 302.

As shown in FIG. 7, the surface 302*b* further includes a continuous plane 308 connected to the discontinuous dents 306, which means the discontinuous dents 306 spaced apart from each other in this embodiment are connected to each other via the continuous plane 308. In other words, the region other than the discontinuous dents 306 on the bottom surface 302*b* is the continuous plane 308. In addition, as shown in FIG. 7, the discontinuous dent 306 has a maximum depth D3 from the continuous plane 308. In some embodiments, the maximum depth D3 of the discontinuous dent 306 is between approximately 0.1 mm and approximately 0.2 mm. Moreover, as shown in FIG. 7, the discontinuous dents 306 have the non-fixed maximum depth D3. In other words, as shown in FIG. 7, the bottoms of at least two of the discontinuous dents 306 on the surface 302*b* are not on the same plane, but the present invention is not limited thereto. In other embodiments, the discontinuous dents 306 may have the fixed maximum depth D3. In other words, the discontinuous dents 306 on the surface 302*b* have the bottoms on the same plane. In addition, in this embodiment, the maximum depth D3 of the discontinuous dent 306 is less than the maximum depth D1 of the polishing grooves 104.

In this embodiment, the base layer 302 is a non-porous layer, but the present invention is not limited thereto. In other embodiments, the base layer 302 may be a porous layer. In still other embodiments, the base layer 302 may include a porous layer and a non-porous layer. In some of these embodiments, the non-porous layer covers the porous layer, which means the surface 302*a* is located on the upper surface of the non-porous layer, while the surface 302*b* is located on the lower surface of the non-porous layer. In some of these embodiments, the non-porous layer is only located on the porous layer, which means the non-porous layer is closer to the adhesive layer 110 than the porous layer, and the surface 302*b* is located on the lower surface of the porous layer. In some of these embodiments, the non-porous layer is only located under the porous layer, which means the porous layer is closer to the adhesive layer 110 than the non-porous layer, and the surface 302*b* is located on the lower surface of the non-porous layer. In addition, the porous layer and the non-porous layer may be made of the same material (such as a polymer material).

Moreover, the non-porous layer may be a skin layer, while the porous layers may be a body layer. The body layer and the skin layer may be made of the same polymer material.

In this embodiment, as shown in FIG. 7, the adhesive layer 304 is disposed below the base layer 302. In detail, the adhesive layer 304 is adhered to the surface 302*b* of the base layer 302. In one embodiment, the adhesive layer 304 may be used to make the surface 302*b* of the base layer 302 adhere to a polishing platen (not shown). In other words, the polishing pad 300 may adhere to and be fixed on the polishing platen (not shown) through the adhesive layer 304 adhering to the surface 302*b*. In this embodiment, the adhesive layer 304 is a continuous adhesive layer, and the adhesive layer includes (but is not limited to): a carrier-free adhesive layer or a double-sided adhesive layer. The material of the adhesive layer is, for example (but not limited to): an acrylic-based adhesive, a silicone-based adhesive, a rubber-based adhesive, an epoxy resin-based adhesive, or a polyurethane-based adhesive, but the present invention is not limited thereto.

As shown in FIG. 7, the adhesive layer 304 is filled into the discontinuous dents 306 on the surface 302*b*. In this way, the contact area of the adhesive layer 304 and the base layer 302 may be increased, thereby increasing the adhesive holding force between the adhesive layer 304 and the base layer 302, such that the polishing pad 300 may stay adhered to the polishing machine in a favorable way during the polishing process and may have improved stability. In addition, since the discontinuous dents 306, similar to the discontinuous dents 106, may be formed into a hook-like shape, between the adhesive layer 304 that is subsequently filled into the surface 302*b* and the base layer 302 may exist a hook-like contact area. In this way, when an external force is applied to the base layer 302, the adhesive layer 304 and the base layer 302 may tightly adhere to each other with the hook-like contact area, such that the adhesive layer 304 and the base layer 302 are not detached due to the external force. Therefore, the adhesive holding force between the adhesive layer 304 and the base layer 302 may be effectively improved.

From another point of view, during the polishing process, by filling the adhesive layer 304 into the discontinuous dents 306 disposed in the polishing track region A on the surface 302*b*, an anti-reverse force may be generated to resist against the shear force generated by the relative movement between the object 200 and the polishing surface 102*a* of the polishing layer 102 during the polishing process. In other words, the adhesive layer 304 and the base layer 302 have good anti-shear force characteristics. In this way, when the polishing pad 300 is used to perform the polishing process on the object 200, the discontinuous dents 306 located in the polishing track region A are disposed on the surface 302*b* and may reduce the impact of the shear force on the adhesive layer 304, thereby reducing the occurrence of degumming of the adhesive layer 304 and improving the adhesive holding power thereof. In some embodiments, the shear force mentioned above belongs to an annular cyclic shear force based on the principles of mechanics, and is generated in the annular direction due to the rotating and swinging movement of the object 200 on the polishing pad during the polishing process.

Figure 8:
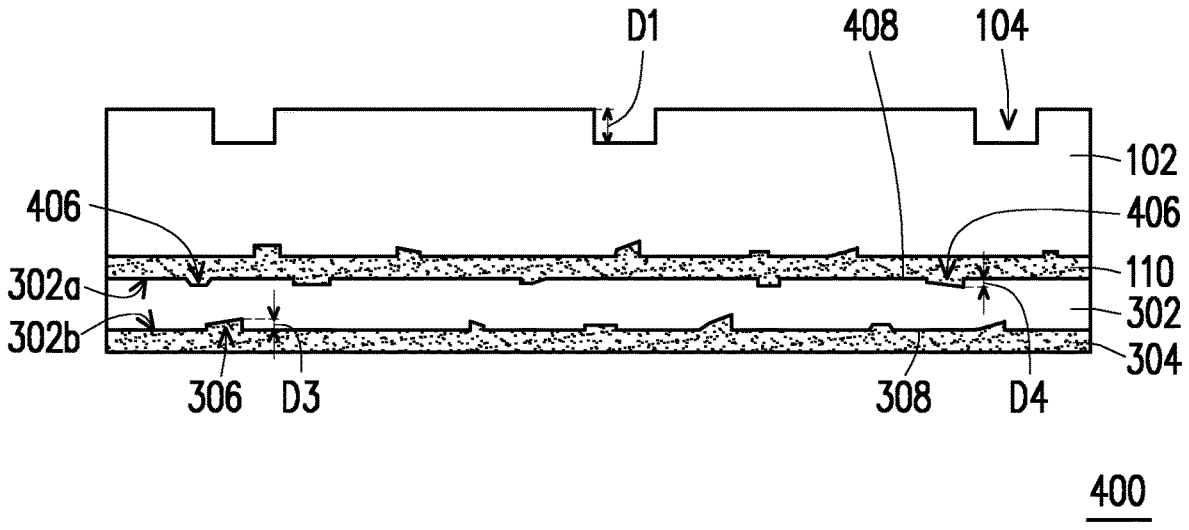
FIG. 8 is a schematic cross-sectional view of a polishing pad according to another embodiment of the present invention.

FIG. 8 is a schematic cross-sectional view of a polishing pad according to another embodiment of the present invention. With reference to FIG. 8 and FIG. 7 together, a polishing pad 400 of FIG. 8 is similar to the polishing pad 300 of FIG. 7. The same or similar elements are denoted by the same or similar reference numerals, and the related description is not repeated herein. The differences between the two are explained as follows.

As shown in FIG. 8, in the polishing pad 400, in addition to the discontinuous dents 306 on the surface 302*b* of the base layer 302, the surface 302*a* further includes a plurality of discontinuous dents 406. In other words, in the embodiment shown in FIG. 8, the two surfaces (i.e., the surface 302*a* and the surface 302*b*, which may be referred to as the upper surface and the lower surface) of the base layer 302 may be regarded as rough surfaces. The discontinuous dent 406 in the embodiment shown in FIG. 8 is the same as or similar to the counterpart (i.e., the discontinuous dent 106) in the embodiment shown in FIG. 1. As some of the details related to the discontinuous dent 106 have been described in the previous embodiments and are not repeated herein, reference may be made to the previous embodiments shown in FIG. 1 to FIG. 6D for the description of the omitted part.

As shown in FIG. 8, the surface 302*a* further includes a continuous plane 408 connected to the discontinuous dents 406, which means the discontinuous dents 406 spaced apart from each other in this embodiment are connected to each other via the continuous plane 408. In other words, the region other than the discontinuous dents 406 on the bottom surface 302*a* is the continuous plane 408. In addition, as shown in FIG. 8, the discontinuous dent 406 has a maximum depth D4 from the continuous plane 408. In some embodiments, the maximum depth D4 of the discontinuous dent 406 is between approximately 0.1 mm and approximately 0.2 mm. Moreover, as shown in FIG. 8, the discontinuous dents 406 have the non-fixed maximum depth D4. In other words, as shown in FIG. 8, the bottoms of at least two of the discontinuous dents 406 on the surface 302*a* are not on the same plane, but the present invention is not limited thereto. In other embodiments, the discontinuous dents 406 may have the fixed maximum depth D4. In other words, the discontinuous dents 406 on the surface 302*a* have the bottoms on the same plane. In addition, in this embodiment, the maximum depth D4 of the discontinuous dent 406 is less than the maximum depth D1 of the polishing grooves 104.

In an embodiment where the base layer 302 includes a porous layer and a non-porous layer, and the non-porous layer covers the porous layer, the surface 302*a* is located on the non-porous layer. In other words, in this embodiment, the two surfaces (i.e., the surface 302*a* and the surface 302*b*) of the base layer 302 are both located on the non-porous layer.

In this embodiment, as shown in FIG. 8, the adhesive layer 110 is filled into the discontinuous dents 406 on the surface 302*a*. In this way, the contact area of the adhesive layer 110 and the base layer 302 may be increased, thereby increasing the adhesive holding force between the adhesive layer 110 and the base layer 302, such that the polishing pad 400 may stay adhered to the polishing machine in a favorable way during the polishing process and may have improved stability. In addition, since the discontinuous dents 406, similar to the discontinuous dents 106, may be formed into a hook-like shape, between the adhesive layer 110 that is subsequently filled into the surface 302*a* and the base layer 302 may exist a hook-like contact area. In this way, when an external force is applied to the base layer 302, the adhesive layer 110 and the base layer 302 may tightly adhere to each other with the hook-like contact area, such that the adhesive layer 110 and the base layer 302 are not detached due to the external force. Therefore, the adhesive holding force between the adhesive layer 110 and the base layer 302 may be effectively improved.

From another point of view, during the polishing process, by filling the adhesive layer 110 into the discontinuous dents 406 disposed in the polishing track region A on the surface 302*a*, an anti-reverse force may be generated to resist against the shear force generated by the relative movement between the object 200 and the polishing surface 102*a* of the polishing layer 102 during the polishing process. In other words, the adhesive layer 110 and the base layer 302 have good anti-shear force characteristics. In this way, when the polishing pad 400 is used to perform the polishing process on the object 200, the discontinuous dents 406 located in the polishing track region A are disposed on the surface 302*a* and may reduce the impact of the shear force on the adhesive layer 110, thereby reducing the occurrence of degumming of the adhesive layer 110 and improving the adhesive holding power thereof. In some embodiments, the shear force mentioned above belongs to an annular cyclic shear force based on the principles of mechanics, and is generated in the annular direction due to the rotating and swinging movement of the object 200 on the polishing pad during the polishing process.

In addition, as shown in FIG. 7 and FIG. 8, both the polishing layer 102 and the base layer 302 in the polishing pad 300 and the polishing pad 400 have rough surfaces (such as the bottom surface 102*b* of the polishing layer 102, the surface 302*a* of the base layer 302, and the surface 302*b* of the base layer 302), but the present invention is not limited thereto. In other embodiments, the polishing layer 102 may not have a rough surface. In other words, the polishing layer and the base layer fall within the scope of the present invention as long as at least one of them has a rough surface. In addition, in other embodiments, the base layer 302 may have the surface 302*a* as the only rough surface.

Figure 9:
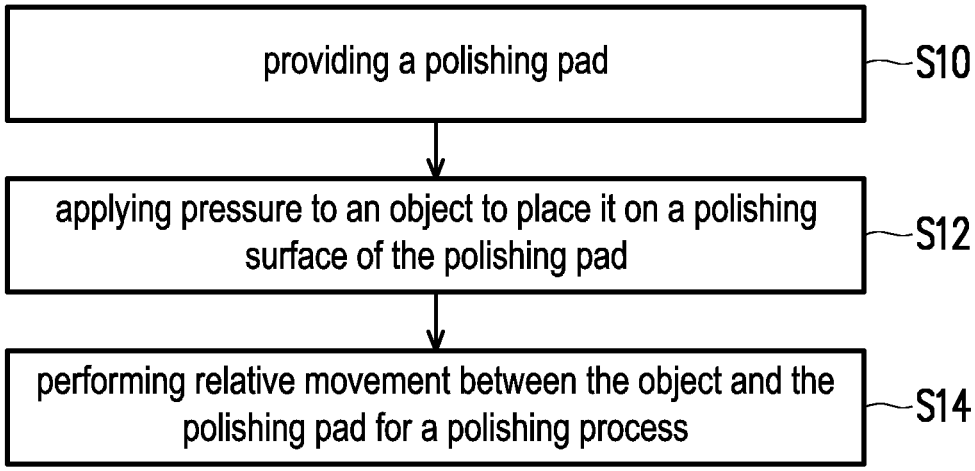
FIG. 9 is a flowchart of a polishing method according to another embodiment of the present invention.

FIG. 9 is a flowchart of a polishing method according to an embodiment of the present invention. This polishing method is adapted for polishing an object. In detail, this polishing method may be applied to a polishing process of manufacturing industrial elements, such as elements used in the electronics industry, which may include semiconductors, integrated circuits, micro-electromechanics, energy conversion elements, communication elements, optical elements, storage discs, displays, and other elements. Objects for manufacturing these elements may include semiconductor wafers, III-V wafers, storage element carriers, ceramic substrates, high molecular polymer substrates, glass substrates, and the like. However, these are not used to limit the scope of the present invention.

With reference to FIG. 9, in step S10, a polishing pad is provided first. In detail, in this embodiment, the polishing pad may be any one of the polishing pads in the previous embodiments, such as the polishing pad 100/300/400. The description related to the polishing pad 100/300/400 has been provided in detail above and is not repeated herein.

Next, in step S12, a pressure is applied to an object so that the object is placed on the polishing pad and contacts the polishing pad. In detail, in this embodiment, the object may be the object 200 in the previous embodiments, and the description related to the object 200 has been provided in detail above and is not repeated herein. In addition, as mentioned above, the object contacts the polishing surface 102*a* of the polishing layer 102 of the polishing pad 100/300/400. Moreover, the method of applying a pressure to the object is performed by, for example, using a carrier that may hold the object.

Afterward, in step S14, relative movement between the object and the polishing pad is performed for using the polishing pad to perform a polishing process on the object for planarization. In detail, relative movement between the object and the polishing pad is performed by, for example, rotating the polishing platen to drive the polishing pad fixed on the polishing platen to rotate.

Although the present invention has been disclosed in the above embodiments, the embodiments are not intended to limit the present invention. Persons skilled in the art may make some changes and modifications without departing from the spirit and scope of the present invention. The protection scope of the present invention shall be defined by the appended claims.

What is claimed is:

1. A polishing pad, adapted for polishing an object and having a polishing track region, wherein the polishing pad comprises:

a polishing layer, having a polishing surface and a rough bottom surface opposite to each other, wherein the rough bottom surface comprises a plurality of discontinuous dents, at least one of the discontinuous dents has a hook shape with a depth gradient along the rough bottom surface; and an adhesive layer, directly adhering to the rough bottom surface of the polishing layer so that all of the discontinuous dents on the rough bottom surface are filled with the adhesive layer.

2. The polishing pad according to claim 1, wherein the plurality of discontinuous dents have fixed spacing, such that the plurality of discontinuous dents are regularly distributed on the rough bottom surface.

3. The polishing pad according to claim 1, wherein the plurality of discontinuous dents have non-fixed spacing, such that the plurality of discontinuous dents are irregularly distributed on the rough bottom surface.

4. The polishing pad according to claim 1, wherein a distribution pattern of the plurality of discontinuous dents comprises a parallel pattern, a non-parallel pattern, a mesh pattern, a radial pattern, or a ring pattern.

5. The polishing pad according to claim 1, wherein at least two of the plurality of discontinuous dents are located on a same virtual extension line.

6. The polishing pad according to claim 1, wherein the plurality of discontinuous dents are disposed in the polishing track region.

7. The polishing pad according to claim 1, wherein the plurality of discontinuous dents comprises wear marks, knife marks, imprint marks, impact marks, or a combination thereof.

8. The polishing pad according to claim 1, wherein a region other than the plurality of discontinuous dents in the rough bottom surface is a continuous plane.

9. The polishing pad according to claim 8, wherein the polishing layer is a non-porous layer.

10. The polishing pad according to claim 8, wherein the polishing layer comprises a porous layer and a non-porous layer, and the non-porous layer covers the porous layer.

11. The polishing pad according to claim 8, wherein the polishing layer comprises a porous layer and a non-porous layer, the porous layer is located under the non-porous layer, and the rough bottom surface is located on a bottom surface of the porous layer.

12. The polishing pad according to claim 8, wherein the polishing layer comprises a porous layer and a non-porous layer, the non-porous layer is located under the porous layer, and the rough bottom surface is located on a bottom surface of the non-porous layer.

13. A polishing method, comprising:

providing the polishing pad according to claim 1;

applying a pressure to an object to place the object on the polishing surface of the polishing pad; and performing relative movement between the object and the polishing pad for a polishing process.

14. A polishing pad, adapted for polishing an object and having a polishing track region, wherein the polishing pad comprises:

a polishing layer;

a base layer, comprising an upper surface and a lower surface that are relatively disposed, disposed below the polishing layer with the upper surface facing the polishing layer, wherein the base layer has a rough surface on the lower surface, and the rough surface comprises a plurality of discontinuous dents, wherein a material of the base layer is selected from at least one of polyurethane, polybutadiene, polyethylene, polypropylene, a copolymer of polyethylene and ethylene vinyl acetate, and a copolymer of polypropylene and ethylene vinyl acetate, and at least one of the discontinuous dents has a hook shape with a depth gradient along the rough surface; and an adhesive layer, directly adhering to the rough surface of the base layer so that all of the discontinuous dents on the rough bottom surface are filled with the adhesive layer.

15. The polishing pad according to claim 14, wherein the plurality of discontinuous dents have fixed spacing, such that the plurality of discontinuous dents are regularly distributed on the rough surface.

16. The polishing pad according to claim 14, wherein the plurality of discontinuous dents have non-fixed spacing, such that the plurality of discontinuous dents are irregularly distributed on the rough surface.

17. The polishing pad according to claim 14, wherein a distribution pattern of the plurality of discontinuous dents comprises a parallel pattern, a non-parallel pattern, a mesh pattern, a radial pattern, or a ring pattern.

18. The polishing pad according to claim 14, wherein at least two of the plurality of discontinuous dents are located on a same virtual extension line.

19. The polishing pad according to claim 14, wherein the plurality of discontinuous dents are disposed in the polishing track region.

20. The polishing pad according to claim 14, wherein the plurality of discontinuous dents comprises wear marks, knife marks, imprint marks, impact marks, or a combination thereof.

21. The polishing pad according to claim 14, wherein a region other than the plurality of discontinuous dents in the rough surface is a continuous plane.

22. The polishing pad according to claim 21, wherein the base layer is a non-porous layer.

23. The polishing pad according to claim 21, wherein the base layer comprises a porous layer and a non-porous layer, and the non-porous layer covers the porous layer.

24. The polishing pad according to claim 21, wherein the rough surface is located on the upper surface and the lower surface of the base layer.

25. A polishing method, comprising:

providing the polishing pad according to claim 14;

applying a pressure to an object to place the object on the polishing surface of the polishing pad; and performing relative movement between the object and the polishing pad for a polishing process.

* * * * *